US007042359B2

(12) United States Patent
Clucas

(10) Patent No.: US 7,042,359 B2
(45) Date of Patent: May 9, 2006

(54) METHOD AND APPARATUS TO DETECT A PLURALITY OF SECURITY TAGS

(75) Inventor: Robert A. Clucas, Pompano Beach, FL (US)

(73) Assignee: Sensormatic Electronics Corporation, Boca Raton, FL (US)

( * ) Notice: Subject to any disclaimer, the term of this patent is extended or adjusted under 35 U.S.C. 154(b) by 68 days.

(21) Appl. No.: 10/698,910

(22) Filed: Oct. 31, 2003

(65) Prior Publication Data

US 2005/0040950 A1 Feb. 24, 2005

Related U.S. Application Data

(60) Provisional application No. 60/497,214, filed on Aug. 23, 2003.

(51) Int. Cl.
*G08B 13/14* (2006.01)

(52) U.S. Cl. ..... 340/572.1; 340/10.1; 340/10.3; 340/572.4

(58) Field of Classification Search ..... 340/572.1, 340/572.7, 572.4, 572.5, 10.1, 10.3, 10.31, 340/10.32; 235/435, 436, 439, 440

See application file for complete search history.

(56) References Cited

U.S. PATENT DOCUMENTS

| | | | | |
|---|---|---|---|---|
| 4,249,167 | A * | 2/1981 | Purinton et al. | 340/572.2 |
| 4,646,090 | A * | 2/1987 | Mawhinney | 342/44 |
| 4,704,602 | A * | 11/1987 | Asbrink | 340/551 |
| 5,030,807 | A * | 7/1991 | Landt et al. | 235/375 |
| 5,446,447 | A * | 8/1995 | Carney et al. | 340/572 |
| 5,519,381 | A * | 5/1996 | Marsh et al. | 340/10.2 |
| 5,604,485 | A * | 2/1997 | Lauro et al. | 340/572 |
| 5,955,951 | A | 9/1999 | Wischerop et al. | 340/572.8 |
| 6,362,738 | B1 * | 3/2002 | Vega | 340/572.1 |
| 2004/0148226 | A1 * | 7/2004 | Shanahan | 705/26 |
| 2004/0233042 | A1 * | 11/2004 | Piccoli et al. | 340/10.1 |

* cited by examiner

*Primary Examiner*—Daniel Wu
*Assistant Examiner*—Travis Hunnings

(57) ABSTRACT

A method and apparatus to detect a plurality of different security tags are described. A method to detect security tags may include establishing an interrogation zone using at least two signals operating at different frequencies; monitoring the interrogation zone to detect a plurality of security tags, with a first type of security tag responsive to at least a first signal at a first frequency and a second type of security tag responsive to at least a second signal at a second frequency; determining whether to generate an alarm if a security tag is detected by receiving a third signal including a combination of the first and second signals from a first security tag of the first type and filtering the third signal to remove frequency components of the first signal; and generating the alarm in accordance with said determination.

32 Claims, 4 Drawing Sheets

METHOD AND APPARATUS TO DETECT A PLURALITY OF SECURITY TAGS

RELATED APPLICATIONS

This non-provisional patent application claims priority to provisional patent application Ser. No. 60/497,214 by Robert Arthur Clucas for a "Method And Apparatus To Detect A Plurality Of Security Tags", filed on Aug. 23, 2003.

BACKGROUND

An Electronic Article Surveillance (EAS) system is designed to prevent unauthorized removal of an item from a controlled area. A typical EAS system may comprise a monitoring system and one or more security tags. The monitoring system may create an interrogation zone at an access point for the controlled area. A security tag may be fastened to an item, such as an article of clothing. If the tagged item enters the interrogation zone, an alarm may be triggered indicating unauthorized removal of the tagged item from the controlled area.

An EAS system is typically configured to operate using only one security tag. It may be desirable, however, to use different security tags depending upon various factors, such as the controlled area, tagged item, level of desired security, cost, security procedures and so forth. Consequently, there may be need for improvements in EAS systems to solve these and other problems.

BRIEF DESCRIPTION OF THE DRAWINGS

The subject matter regarded as the embodiments is particularly pointed out and distinctly claimed in the concluding portion of the specification. The embodiments, however, both as to organization and method of operation, together with objects, features, and advantages thereof, may best be understood by reference to the following detailed description when read with the accompanying drawings in which:

DETAILED DESCRIPTION

In one embodiment, a plurality of different Radio Frequency (RF) security tags may be used with an EAS system having a Radio Frequency Identification (RFID) reader that is configured to detect the different types of tags. By having an EAS system capable of detecting different types of tags, it becomes possible to use more expensive RFID security tags on the inventory of interest, and less expensive RF or EAS security tags on the balance of the inventory. Consequently, the inventory of interest may be tracked using the RFID tags, while still being able to detect theft across the entire inventory. Accordingly, the overall cost of the EAS system and corresponding security tags may be reduced, thereby benefiting the manufacturer, retailer and customer. This may be particularly beneficial to those businesses carrying large volumes of inventory that require varying levels of inventory tracking capabilities but total anti-theft solutions, such as found in the video and Digital Video Disk (DVD) rental market, for example.

Numerous specific details may be set forth herein to provide a thorough understanding of the embodiments of the invention. It will be understood by those skilled in the art, however, that the embodiments of the invention may be practiced without these specific details. In other instances, well-known methods, procedures, components and circuits have not been described in detail so as not to obscure the embodiments of the invention. It can be appreciated that the specific structural and functional details disclosed herein may be representative and do not necessarily limit the scope of the invention.

It is worthy to note that any reference in the specification to "one embodiment" or "an embodiment" means that a particular feature, structure, or characteristic described in connection with the embodiment is included in at least one embodiment. The appearances of the phrase "in one embodiment" in various places in the specification are not necessarily all referring to the same embodiment.

Figure 1:
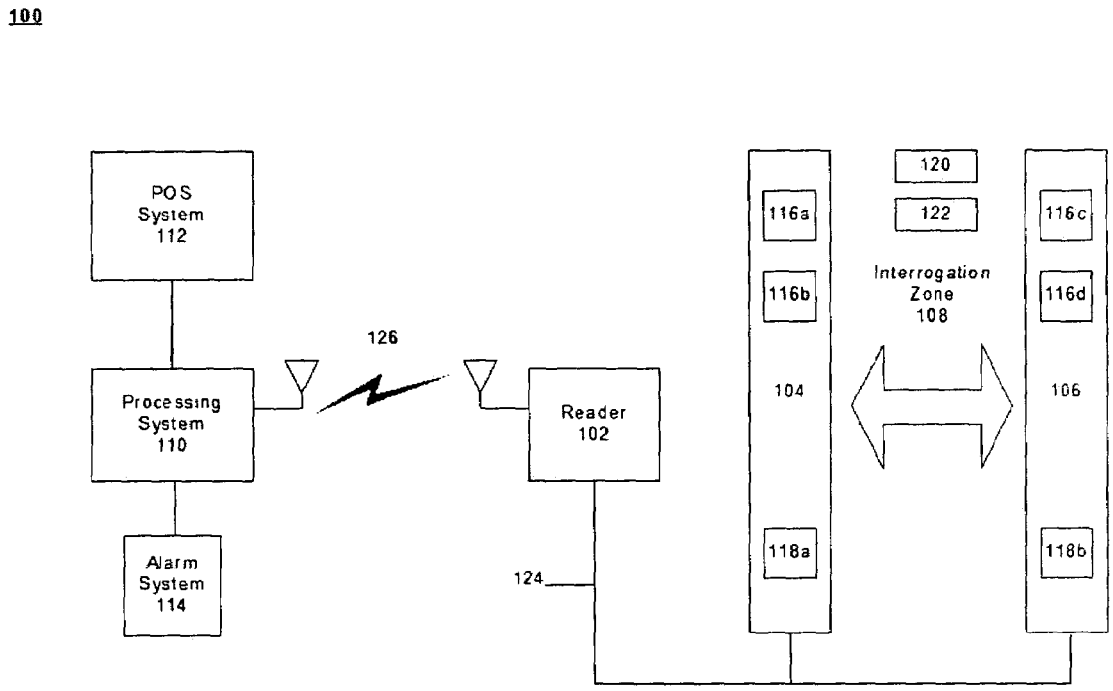
FIG. 1 illustrates a system suitable for practicing one embodiment.

Referring now in detail to the drawings wherein like parts are designated by like reference numerals throughout, there is illustrated in FIG. 1 a system suitable for practicing one embodiment. FIG. 1 illustrates an EAS system 100. EAS system 100 may comprise a set of EAS detection equipment, including a Radio Frequency Identification (RFID) Reader System (RRS) 102 connected to antenna pedestals 104 and 106 via a communications medium 124. The EAS detection equipment is typically installed at an exit point of a controlled area, such as a retail store, for example.

In one embodiment, the EAS detection equipment may be used to create an interrogation zone 108 between antenna pedestals 104 and 106, for example. The interrogation zone may comprise an area receiving interrogation signals from RRS 102 via antennas embedded within antenna pedestals 104 and 106. The interrogation signals may trigger a response from a security tag, such as security tags 120 and 122. The anti-theft functionality of EAS system 100 may be implemented through the interrogation and response interaction between RRS 102 and security tags 120 and 122, for example.

In one embodiment, EAS system 100 may be configured to detect different types of security tags, such as security tags 120 and 122. Security tags 120 and 122 may be designed to attach to an item to be monitored. Examples of tagged items may include an article of clothing, a DVD or Compact Disc (CD) jewel case, a movie rental container, packaging material, and so forth.

In one embodiment, security tag 120 may comprise one or more RF antennas and a RF sensor to emit a detectable signal when in interrogation zone 108. Security tag 120 has fairly low complexity in that it is not configured to emit a signal that provides any information about security tag 120, but rather is limited to indicating the presence of security tag 120 within interrogation zone 108. Examples of the sensor may include any RF sensor modified to operate in accordance with the principles discussed herein. The sensor may also comprise a conventional EAS sensor modified accordingly, such as an acoustically resonant magnetic EAS sensor, a magnetic EAS sensor, and so forth. Further, the sensor may be a sensor that is capable of being deactivated or not deactivated, depending upon a given implementation. The embodiments are not limited with respect to the type of sensor used for security tag 120 as long as it emits a detectable signal at the proper frequencies.

In general operation, security tag 120 may enter interrogation zone 108 and receive a plurality of interrogation signals from RRS 102. Security tag 120 may receive the interrogation signals, and radiate a combined signal in response to the interrogation signals. The combined signal may be a combination of the interrogation signals, for example. The combined signal may be received by RRS 102. RRS 102 may filter the combined signal, determine the remaining signal subsequent to the filtering operation, and determine whether to trigger an alarm based on the results of the determination.

In one embodiment, security tag 122 may be an RFID security tag. An RFID security tag may include a RFID chip. The RFID chip may also emit a detectable signal when in interrogation zone 108. The emitted signal, however, may include information about security tag 122. The RFID chip may be capable of storing multi-bit identification data and emitting an identification signal corresponding to the stored data in response to an RF interrogation signal. The amount of stored data may vary according to the RFID chip. In one embodiment, the RFID chip may store over one hundred characters, for example. In one embodiment, the RFID chip is "passive" in the sense that it is powered by the interrogation'signal and does not require a separate battery. Security tag 122 and its operation may be discussed in more detail with reference to FIG. 3.

Security tags 120 and 122 may have similar or different security tag housings, depending upon a particular implementation. For example, in one embodiment the security tag housings may be hard or soft, depending on whether the security tags are designed to be reused. For example, a reusable security tag typically has a hard security tag housing to endure the rigors of repeated attaching and detaching operations. A disposable security tag may have a hard or soft housing, depending on such as factors as cost, size, type of tagged item, visual aesthetics, tagging location, and so forth. The embodiments are not limited in this context.

In one embodiment, EAS system 100 may comprise a RRS 102. RRS 102 may be configured to create an interrogation zone 108 between antenna pedestals 104 and 106. RRS 102 may also be configured to detect the presence of security tag 120 or security tag 122 within interrogation zone 108. Once security tag 120 or security tag 122 are within interrogation zone 108, RSS 102 may determine whether to send an alarm signal to an alarm system, such as alarm system 114.

In one embodiment, RRS 102 may also operate as a data reader and writer for an RFID chip. RRS 102 may interrogate and read the RFID chip included in security tag 122. RRS 102 may also write data into the RFID chip. This may be accomplished using any wireless communication link between RRS 102 and security tag :122, for example. RRS 102 and its operation may be described in more detail with reference to FIG. 2.

In one embodiment, EAS system 100 may comprise a processing system 110. Processing system 110 may comprise any device having a general purpose or dedicated processor, machine-readable memory and computer program segments stored in the memory to be executed by the processor. An example of a processing system may include a computer, server, personal digital assistant, switch, router, laptop, cell phone and so forth. Processing system 110 may be used to store and execute application programs, such as an alarm control system, inventory control system, and so forth. The inventor control system, for example, may track information such as merchandise identification, inventory, pricing, and other data. Processing system 110 may also be configured with the appropriate hardware and/or software to function as an RFID reader, similar to RRS 102. This may be useful for implementing both the inventor tracking functionality and anti-theft functionality of EAS system 100, as discussed further below.

In one embodiment, processing system 110 may be in communication with RSS 102 via a communication link 126. In one embodiment, communication link 126 may comprise a communication link over a wireless communication medium. The wireless communication medium may comprise one or more frequencies from the RF spectrum, for example. Communication link 126 may also represent a communication link over a wired communications medium as well. The wired communications medium may comprise twisted-pair wire, co-axial cable, Ethernet cables, and so forth. The embodiments for the communication link are not limited in this context.

In one embodiment, EAS system 100 may comprise a Point-Of-Sale (POS) terminal 112. POS 112 may comprise any type of POS terminal, such as an electronic cash register or computer, as modified in accordance with the techniques discussed herein. POS 112 may be used to assist in the inventory tracking operations and anti-theft operations by associating a valid transaction such as a payment with the unique identifier. The embodiments are not limited in this context.

In one embodiment, EAS system 100 may comprise an alarm system 114. Alarm system 114 may comprise any type of alarm system to provide an alarm in response to an alarm signal received from processing system 110 via RRS 102 or processing system 110. Alarm system 114 may comprise a user interface to program conditions or rules for triggering an alarm. Examples of the alarm may comprise an audible alarm such as a siren or bell, a visual alarm such as flashing lights, or an inaudible alarm such as a message to a monitoring system for a security company. The message may be sent via a computer network, a telephone network, a paging network, and so forth. The embodiments are not limited in this context.

Although FIG. 1 illustrates a limited number of components for purposes of clarity, it can be appreciated that any number of additional components may be added and still fall within the scope of the embodiments. For example, EAS system 100 may also comprise a base station for a portable read-write unit. A wireless data link may permit data to be exchanged between the portable unit and the base station. Alternatively, the base station may include a docking station to allow the portable unit to be connected by direct contacts or another communication link with the base station. The function of the portable unit may be to read data from a security tag, such as security tag 122, for the purpose of taking inventory. The portable unit may also have the capability to write data into security tag 122. For example, the portable unit may be employed to write data into the RFID chip of security tag 122 at the time when the tags are applied to items of merchandise. The embodiments are not limited in this context.

In one embodiment, EAS system 100 may provide a lower cost RFID inventory control and theft deterrent system. In conventional EAS systems, all tagged items may need to be tagged with RFID security tags, such as security tag 122, in order to provide inventory analysis and to prevent the theft of the tagged items. This could be relatively expensive due to the increased costs associated with the RFID security tags. EAS system 100 may provide a solution that permits partial tagging of some tagged items by one type of security tag, such as security tag 120, and another type of security tag, such as security tag 122. EAS system 100 may utilize a reader such as RRS 102 to detect both types of security tags, thereby implementing the anti-theft functionality for EAS system 100, while potentially reducing the overall cost of the security tags used by EAS system 100.

Figure 2:
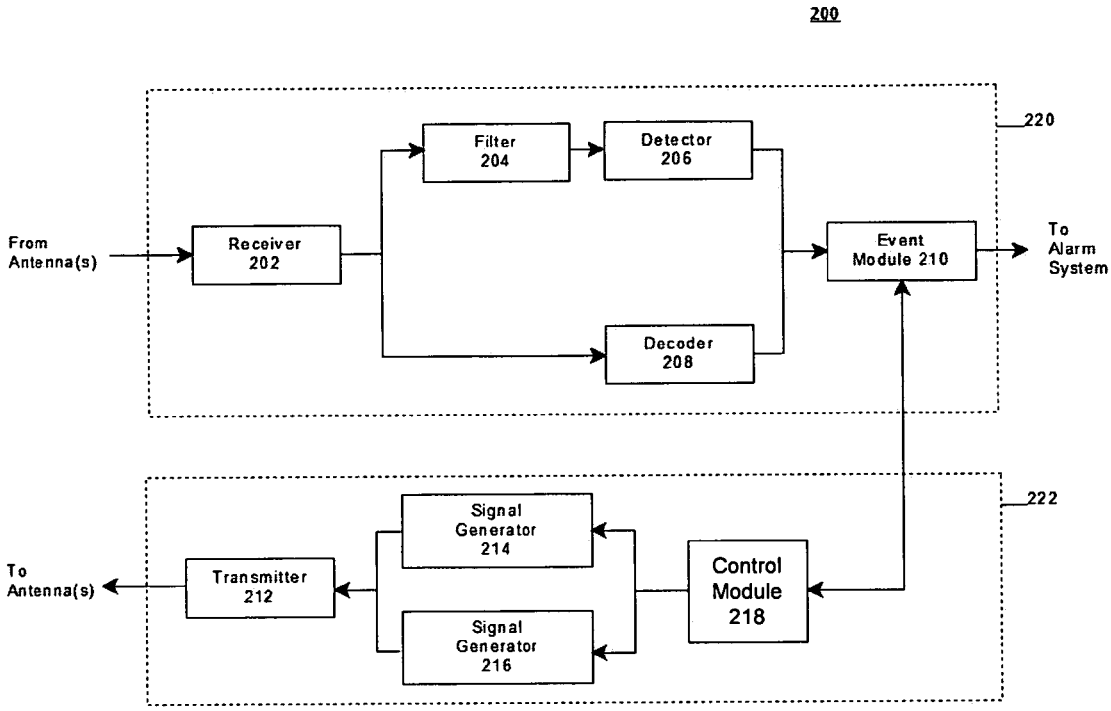
FIG. 2 illustrates a block diagram of a RFID Reader System (RRS) in accordance with one embodiment.

FIG. 2 may illustrate a RRS in accordance with one embodiment. FIG. 2 may illustrate an RRS 200. RRS 200 may be representative of, for example, RRS 102. RRS 200 and its various components may be implemented using an architecture that may vary in accordance with any number of factors, such as desired computational rate, power levels, heat tolerances, processing cycle budget, input data rates, output data rates, memory resources, data bus speeds and other performance constraints. For example, one embodiment may be implemented using software executed by a processor. The processor may be a general-purpose or dedicated processor, such as a processor made by Intel® Corporation, for example. The software may comprise computer program code segments, programming logic, instructions or data. The software may be stored on a medium accessible by a machine, computer or other processing system. Examples of acceptable mediums may include computer-readable mediums such as read-only memory (ROM), random-access memory (RAM), Programmable ROM (PROM), Erasable PROM (EPROM), magnetic disk, optical disk, and so forth. In one embodiment, the medium may store programming instructions in a compressed and/or encrypted format, as well as instructions that may have to be compiled or installed by an installer before being executed by the processor. In another example, one embodiment may be implemented as dedicated hardware, such as an Application Specific Integrated Circuit (ASIC), Programmable Logic Device (PLD) or Digital Signal Processor (DSP) and accompanying hardware structures. In yet another example, one embodiment may be implemented by any combination of programmed general-purpose computer components and custom hardware components. The embodiments are not limited in this context.

In one embodiment, RRS 200 may comprise one or more modules. Although the embodiment has been described in terms of "modules" to facilitate description, one or more circuits, components, registers, processors, software subroutines, or any combination thereof could be substituted for one, several, or all of the modules.

In one embodiment, RRS 200 may be configured to detect signals from security tags 120 and 122. To accomplish this, RRS 200 may comprise a receive module 220 and a transmit module 222. In one embodiment, receive module 220 may comprise a receiver 202, a filter 204, a detector 206, a decoder 208, and an event module 210. In one embodiment, transmit module 222 may comprise a transmitter 212, signal generators 214 and 216, and a control module 218.

In one embodiment, transmit module 222 may be used to transmit a plurality of signals at different frequencies via two sets of antennas. The first set of antennas may comprise, for example, RFID antennas 116*a*, 116*b*, 116*c* and 116*d*. The second set of antennas may comprise, for example, e-field antennas 118*a* and 118*b*.

In one embodiment, control module 218 may send control signals to activate signal generators 214 and 216. Control module 218 may also contain logic or instructions to control the overall operations of RRS 200, as desired for a particular implementation.

In one embodiment, signal generators 214 and 216 may generate interrogation signals at two different frequencies. For example, signal generator 214 may be a signal generator configured to generate a first interrogation signal at 915 Megahertz (MHz). In another example, signal generator 216 may be a static e-field generator to generate a second interrogation signal at 111.5 Kilohertz (KHz). The first and second signals may be sent to transmitter 212.

In one embodiment, transmitter 212 may transmit the first and second operating signals via the antennas. In one embodiment, for example, transmitter 212 may transmit the first signal using the first set of antennas, and the second signal using the second set of antennas.

In one embodiment, receive module 220 may be used to receive a plurality of signals at different frequencies via the two sets of antennas. Receiver 202 may receive the plurality of signals from the first and second sets of antennas. In one embodiment, one of the plurality of signals may comprise a third signal received from security tag 120, for example. The third signal may be, for example, a combination of the first and second signals. Receiver 202 may send the third signal to filter 204.

In one embodiment, filter 204 may receive the third signal. Filter 204 may filter the third signal to remove the frequency components for one of the two interrogation signals. In one embodiment, for example, filter 204 is configured to filter out the first signal. Filter 204 may send the filtered signal to detector 206.

In one embodiment, detector 206 may receive the filtered signal and determine whether the filtered-signal comprises the second signal. If the filtered signal does comprise the second signal, then detector 206 may send a signal to event module 210 indicating that the second signal is present.

In one embodiment, event module 210 may generate an event signal in response to the signal from detector 206. The event signal may be used to perform a number of functions according to a given application. For example, the event signal may comprise an alarm signal to be sent to an alarm system, such as alarm system 114. Alarm system 114 may trigger an alarm based on the alarm signal.

In one embodiment, one of the plurality of signals may comprise a fourth signal received from security tag 122, for example. The fourth signal may represent, for example, information stored by the RFID chip. In one embodiment, the information may comprise security tag information, such as an identifier for the security tag and an exit code. The term "exit code" as used herein may refer to a code indicating that security tag 122 may pass through interrogation zone 108 without triggering the alarm. Receiver 202 may send the fourth signal to decoder 208.

In one embodiment, decoder 208 may receive the fourth signal and decode the security tag information from the fourth signal. The decoded security tag information may be sent to event module 210.

In one embodiment, event module 210 may receive the decoded security tag information. The decoded security tag information may comprise an identifier for the security tag and an exit code, if any. Event module 210 may send the information to control module 218 for processing.

In one embodiment, control module 218 may determine whether an alarm should be triggered using the decoded information. For example, control module 218 may compare the identifier and/or the exit code to a list of valid identifiers. The term "valid" as used herein may refer to those identifiers that are permitted to cross interrogation zone 108 without triggering an alarm. The list of valid identifiers may be compiled using information received from POS 112, for example. The valid identifiers may represent those security tags attached to tagged items that have been paid for at POS 112, for example. If the identifier is on the list of valid identifiers, then an event signal may not be sent to alarm system 114. If the identifier is not on the list of valid identifiers, however, then control module 218 may send a signal to event module 210 indicating that an event signal should be sent to alarm system 114. Event module 210 may receive the signal from control module 218, and send the event signal in response to received signal.

Figure 3:
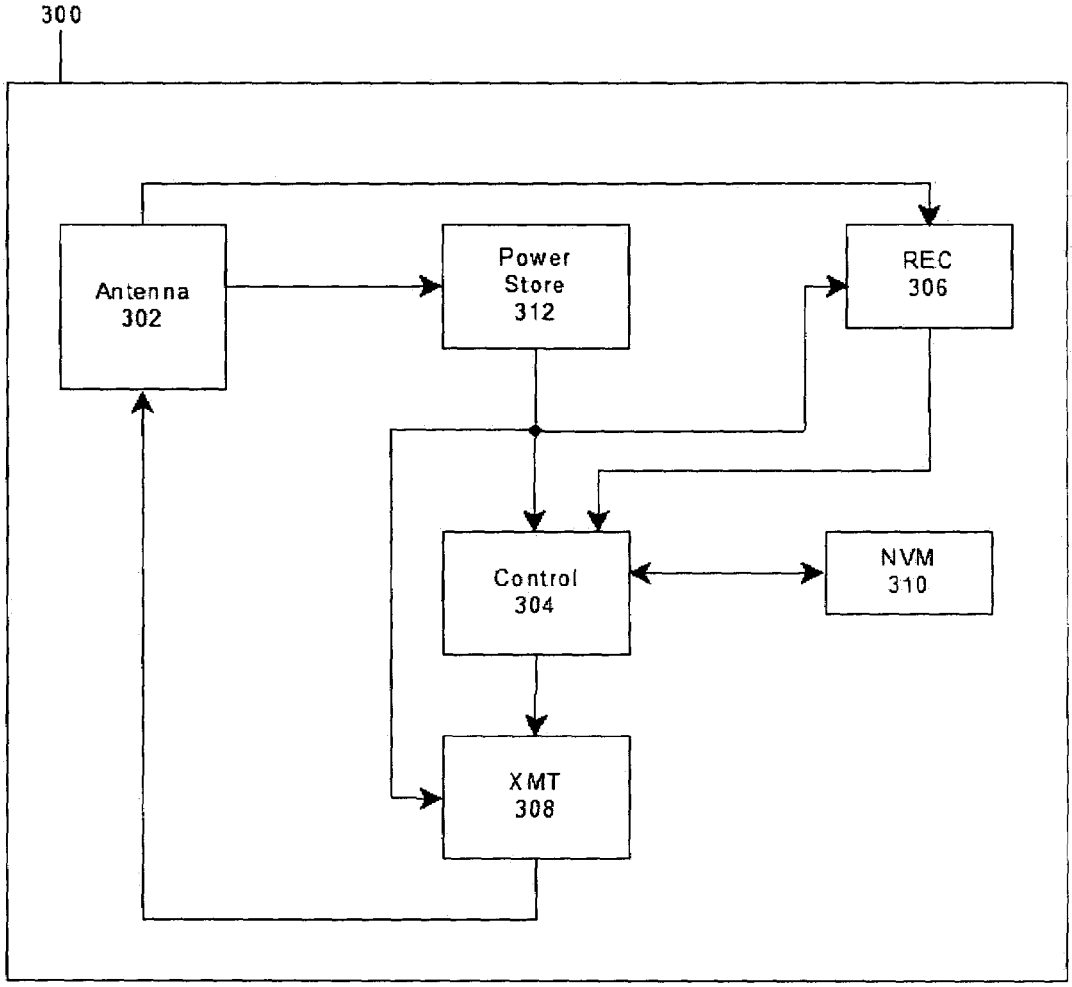
FIG. 3 illustrates a block diagram of a Radio Frequency Identification (RFID) tag in accordance with one embodiment.

FIG. 3 illustrates a block diagram of an RFID chip in accordance with one embodiment. FIG. 3 may illustrate an RFID chip 300. RFID chip 300 may be representative of the RFID chip used for security tag 122, for example.

In one embodiment, RFID chip 300 may include an antenna structure 302. Antenna structure 302 may be tuned to receive a signal that is at the frequency of the interrogation signal(s) of EAS system 100. In one embodiment, for example, antenna structure 302 may be tuned to the frequency for the second interrogation signal, or 111.5 KHz.

In one embodiment, RFID chip 300 may comprise a control module 304. Control module 304 may control the overall operation and management of RFID chip 300. It may also control memory management and Input/Output (I/O) processing for Non-Volatile Memory (NVM) 310.

In one embodiment, RFID chip 300 may comprise a receive module 306. Receive module 306 may be connected between antenna 302 and control module 304. Receive module 306 may function to capture data signals carried by the carrier-signal to which antenna 302 is tuned. In one embodiment, the data signal may be generated by a component of EAS system 100, such as RRS 102, for example. The data signal may be generated by on/off keying of the carrier signal, and the receive circuit is arranged to detect and capture the on-off keyed data signal.

In one embodiment, RFID chip 300 may comprise a transmit module 308. Transmit module 308 may also be connected between antenna 302 and control module 304. Under control of control module 304, transmit module 308 may operate to transmit a data signal via antenna 302. For example, the data signal may be generated by transmit module 308 by selectively opening or shorting a reactive element (not separately shown) in antenna structure 302 to provide perturbations in the interrogation signal which are detectable by RRS 102.

In one embodiment, RFID chip 300 may include NVM 310. NVM 310 may store data under control of control module 304, and selectively provides stored data to control module 304. NVM 310 may be used to store, for example, identification data and an exit code for security tag 122. The identification data may be accessed by control module 304 and used to drive transmit module 308 so that the identification data is output by RFID chip 300 as an identification signal. Data to update the identification data stored in NVM 310, or additional data indicative of characteristics of the article of merchandise to which the EAS/ID tag is attached, or indicative of handling or sale of the article of merchandise, may be received via receive module 306 and stored in NVM 310 by control module 304.

In one embodiment, RFID chip 300 may include a power storage module 312. Power storage module 312 may be connected to, antenna structure 302 and accumulates power from a signal induced in antenna structure 302 by an interrogation signal applied to the RFID chip. Power storage module 312 may include, for example, a storage capacitor (not separately shown). Power storage module 312 may supply the power required for operation of RFID chip 300, for example.

In operation, RFID chip 300 may receive an interrogation signal when entering interrogation zone 108. An example of the interrogation signal may comprise the second signal operating at 111.5 KHz, although the embodiments are not limited in this context. RFID chip 300 may use the interrogation signal to power RFID chip 300 via power store 312. Control module 304 may retrieve security tag information stored in NVM 310, and begin transmitting the security tag information via transmitter 308 and antenna 320. The transmitted signal may be received by one or more antennas 116*a–d* of antenna pedestals 104 and/or 106, and processed by RRS 102.

The operations of systems 100–300 may be further described with reference to FIG. 4 and accompanying examples. Although FIG. 4 as presented herein may include a particular programming logic, it can be appreciated that the programming logic merely provides an example of how the general functionality described herein can be implemented. Further, the given programming logic does not necessarily have to be executed in the order presented unless otherwise indicated. In addition, although the given programming logic may be described herein as being implemented in the above-referenced modules, it can be appreciated that the programming logic may be implemented anywhere within the system and still fall within the scope of the embodiments.

Figure 4:
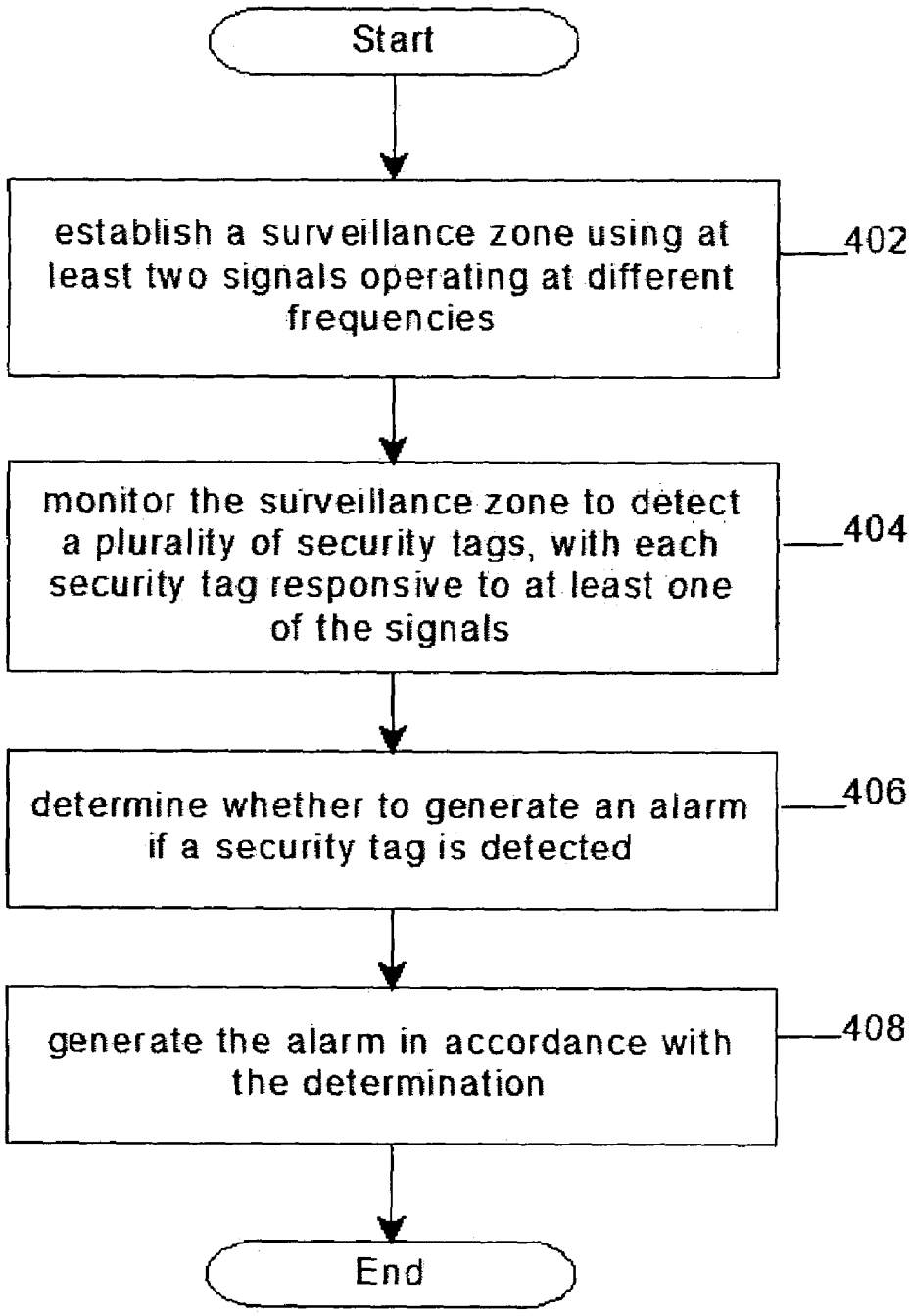
FIG. 4 is a block flow diagram of the programming logic performed by a RSS in accordance with one embodiment.

FIG. 4 illustrates a programming logic 400 for a RRS in accordance with one embodiment. Programming logic 400 may illustrate a programming logic to detect different security tags. As shown in programming logic 400, an interrogation zone may be established using at least two signals operating at different frequencies at block 402. Interrogation zone 108 may be monitored to detect a plurality of security tags, with each security tag responsive to at least one of the signals at block 404. A determination may be made as to whether an alarm should be generated if a security tag is detected at block 406. At block 408, the alarm may be generated in accordance with the determination made at block 406.

In one embodiment, interrogation zone 108 may be established by transmitting two different signals. For example, a first signal may be transmitted at a first frequency, and a second signal may be transmitted at a second frequency. In one embodiment, the first frequency may operate at approximately 915 MHz, and the second frequency may operate at approximately 111.5 KHz, for example.

In one embodiment, interrogation zone 108 may be monitored to detect signals from a first security tag, such as security tag 120. In one embodiment, for example, the monitoring may comprise receiving a third signal at a third frequency from a first security tag in response to the first and second signals. The third signal may be a combination of the first and second signals, for example. The alarm determination may be made by sending the third signal to a filter. The filter may filter the third signal to remove the first signal. A determination may be made as to whether the second signal remains after the filtering operation. If the second signal does remain, then an alarm signal may be sent to an alarm system. The alarm system may receive the alarm signal. The alarm may be triggered in response to the alarm signal.

In one embodiment, interrogation zone 108 may be monitored to detect signals from a second security-tag, such as security tag 122, for example. In one embodiment, the monitoring may comprise receiving a fourth signal from a second security tag in response to the second signal. The fourth signal may represent security tag information stored by the second security tag. An example of security tag information may include an identifier for the second security tag.

In one embodiment, a determination may be made as to whether an alarm should be generated if the second security tag is detected in interrogation zone 108. In one embodiment, the determination may be made by decoding the security tag information from the fourth signal to retrieve the identifier. The identifier may be compared to a list of valid identifiers. A determination may be made as to whether the identifier is valid based on the comparison. An alarm signal may be sent to the alarm system if the identifier is not valid. The alarm system may receive the alarm signal. The alarm may be triggered in response to the alarm signal.

In one embodiment, a plurality of security tags may be used with an EAS system, such as EAS system 100. A first security tag may receive a first and second signal having a first and second frequency, respectively. The first security tag may transmit a third signal in response to the first and second signals. A second security tag may also receive the second signal. The second security tag may transmit a fourth signal in response to the second signal. The fourth signal may represent an identifier for the second security tag and a first code.

In one embodiment, the second security tag may receive a fifth signal in response the fourth signal. The fifth signal may represent, for example, the identifier for the second security tag and a second code. The fifth signal maybe generated by RRS 102, for example. After a valid transaction has occurred at POS system 112, RRS 102 may be instructed to send the fifth signal with the second code. The second code may be a code indicating that the second security tag and the tagged item may be authorized to leave the controlled area through interrogation zone 108, for example. The second code may be, stored by the second security tag. The next time the second signal is received by the second security tag, the second security tag may transmit a sixth signal in response to the second signal. The sixth signal may represent, for example, the identifier for the second security tag and the second code.

The operation of systems 100–300, and the programming logic shown in FIG. 4, may be better understood by way of example. In accordance with one embodiment, EAS system 100 may detect a plurality of different security tags thereby allowing different items to be tagged as desired. For example, a retail store may need to track and analyze sales of the more valuable items of the store. Typically these represent a relatively small percentage (e.g., 20%) of the total inventory of the store. The 20% of high value items may be tagged with more expensive RFID security tags, such as security tag 122. Security tag 122 may be capable of storing and transmitting multiple bits of information uniquely identifying the tagged item. The remainder of the inventory may be tagged with less expensive tags, such as security tag 120. Security tag 120 may be an RF security tag capable of producing a signal in an interrogation zone to indicate its presence, but is not necessarily capable of uniquely identifying the security tag or tagged item.

In one embodiment, antenna pedestals 104 and 106 may be located at the point of ingress or egress of the controlled area. RRS 102 may use antenna pedestals 104 and 106 to create an interrogation zone 108 through which customers must pass. RRS 102 is capable of detecting the presence of both security tag 120 and security tag 122, and triggers the appropriate alarm to indicate a potential theft.

By having a single EAS system configured to detect different security tags, various anti-theft and inventory tracking operations may be accomplished using the different tags. Some examples are outlined below, although the embodiments are not necessarily limited to these examples.

In one example, a customer may pay for the tagged item at POS system 112. The retail clerk may pass the tagged item around interrogation zone 108, and therefore avoid triggering the alarm. Security tag 122 of the tagged item may be interrogated by a reader, such as either RRS 102 or processing system 110, and the information stored in security tag 122 may be used by an inventory control system to perform inventory analysis and sales analysis calculations, as desired for a particular implementation. If either security tag 120 or 122 enter the interrogation zone, however, an alarm may trigger indicating a possible theft or, unauthorized removal.

In another example, a "keeper" may be used to enclose an item while it is in the controlled area. The keeper may be a plastic container or box, such as the containers used to hold DVDs, CDs, VHS movie cassettes, and so forth. Each keeper may be tagged with either security tag 120 or security tag 122. The keepers may be color coded, with one color representing keepers with security tag 120, and a different color representing keepers with security tag 122. The RFID chip of security tag 122 may be encoded with a unique identifier corresponding to the item enclosed within the keeper. Through the use of the keeper, the item may be tracked for inventory purposes, sales analysis, and unauthorized removal from the store. Once the item is purchased at POS 112, the item may be removed from the keeper, thereby allowing the item to pass through interrogation zone 108 without triggering the alarm. If either keeper enters the interrogation zone, however, an alarm may once again trigger to indicate a possible theft or unauthorized removal.

In yet another example, security tags 120 and 122 may each be modified to allow them to be activated and deactivated, respectively. A activation/deactivation module (ADM) corresponding to the type of modified security tag may be used as part of EAS system 100. Interrogation zone 108 of EAS system 100 may be configured to detect only the active tags. In this arrangement, security tag 120 may be deactivated by the ADM using conventional techniques, such as exposing the sensor of security tag 120 to a powerful magnetic field, for example. Security tag 122 may be deactivated by writing an exit code to the RFID chip after a valid transaction has occurred at POS 112, for example. When the deactivated security tag 120 passes through interrogation zone 108, no response signal is generated and the alarm is not triggered. As the deactivated security tag 122 passes through interrogation zone 108, RRS 102 may interrogate security tag 122 for the exit code. If the proper code is received by. RRS 102, then the item is allowed to pass through interrogation zone 108 without triggering the alarm. If either security tag is activated, however, each will trigger the alarm when passing through interrogation zone 108.

In still another example, when an item tagged with security tag 122 is purchased at POS 112, RRS 102 or processing system 110 may interrogate the RFID chip for its unique identifier. The unique identifier and/or an exit code may be added to the list of valid identifiers. When security tag 122 appears in interrogation zone 108, RRS 102 may read its unique identifier and/or exit code and determine whether it is a valid identifier. If it is a valid identifier, the item may be allowed to pass through interrogation zone 108 without triggering the alarm.

While certain features of the embodiments of the invention have been illustrated as described herein, many modifications, substitutions, changes and equivalents will now occur to those skilled in the art. It is, therefore, to be understood that the appended claims are intended to cover all such modifications and changes as fall within the true spirit of the embodiments of the invention.

The invention claimed is:

1. A method to detect security tags, comprising:

establishing art interrogation zone using at least two signals operating at different frequencies;

monitoring said interrogation zone to detect a plurality of security tags, with a first type of security tag responsive to at least a first signal at a first frequency and a second type of security tag responsive to at least a second signal at a second frequency;

determining whether to generate an alarm if a security tag is detected by receiving a third signal at a third frequency, said third signal comprising a combination of said first and second signals from a first security tag of said first type and filtering said third signal to remove frequency components of only said first signal; and generating said alarm in accordance with said determination.

2. The method of claim 1, wherein said establishing comprises:

transmitting said first signal at said first frequency; and transmitting said second signal at said second frequency.

3. The method of claim 1, wherein said first frequency operates at approximately 915 Megahertz, and said second frequency operates at approximately 111.5 Kilohertz.

4. The method of claim 1, wherein said monitoring comprises receiving said third signal at a third frequency from said first security tag in response to said first and second signals.

5. The method of claim 1, wherein said determining comprises:

determining whether said second signal remains after said filtering; and sending an alarm signal if said second signal remains after said filtering.

6. The method of claim 5, wherein said generating comprises:

receiving said alarm signal; and triggering said alarm in response to said alarm signal.

7. The method of claim 1, wherein said monitoring comprises receiving a fourth signal from a second security tag of said second type in response to said second signal, said fourth signal representing security tag information stored by said second security tag.

8. The method of claim 7, wherein said determining comprises:

decoding said security tag information from said fourth signal, said security tag information comprising an identifier for said second security tag;

comparing said identifier to a list of valid identifiers;

determining whether said identifier is valid based on said comparison; and sending an alarm signal if said identifier is not valid.

9. The method of claim 8, wherein said generating comprises:

receiving said alarm signal; and triggering said alarm in response to said alarm signal.

10. A method to detect security tags, comprising:

receiving a first and second signal having a first and second frequency, respectively, at a first security tag of a first type;

receiving said second signal at a second security tag of a second type;

transmitting a third signal at a third frequency, said third signal comprising a combination of said first and second signals from said first security tag to a reader system in response to said first and second signals, said reader system configured to filter said third signal to remove frequency components of only said first signal; and transmitting a fourth signal from said second security tag in response to said second signal, with said fourth signal representing an identifier for said second security tag and a first code.

11. The method of claim 10, further comprising:

receiving a fifth signal in response to said fourth signal, said fifth signal representing said identifier for said second security tag and a second code;

storing said second code at said security tag;

receiving said second signal at said second security tag; and transmitting a sixth signal from said second security tag in response to said second signal, with said sixth signal representing said identifier for said second security tag and said second code.

12. The method of claim 10, wherein said first frequency operates at approximately 915 Megahertz, and said second frequency operates at approximately 111.5 Kilohertz.

13. A security system, comprising:

at least one antenna;

a transceiver to connect to said antenna and establish an interrogation zone;

a first security tag of a first type to communicate with said transceiver, said first security tag responsive to at least a first signal at a first frequency;

a second security tag of a second type to communicate with said transceiver, said second security tag responsive to at least a second signal at a second frequency; and a reader system to connect to said transceiver and to determine whether either security tag is within said interrogation zone by receiving a third signal at a third frequency, said third signal comprising a combination of said first and second signals from said first security tag and filtering said third signal to remove frequency components of only said first signal.

14. The security system of claim 13, wherein said reader system is configured to send an alarm signal if either security tag is within said interrogation zone.

15. The security system of claim 14, wherein said security system further comprises an alarm system to connect to said reader system, said alarm system to receive said alarm signal and provide an alarm in response to said alarm signal.

16. The security system of claim 13, wherein said second security tag is a Radio Frequency Identification (RFID) tag, said RFID tag further comprising:

an identification module to provide an identifier for said second security tag; and a transmitter to send a signal with said identifier to said transceiver.

17. The security system of claim 13, wherein said first security tag is a radio frequency, tag.

18. The security system of claim 13, further comprising a deactivation module to deactivate said first and second security tags.

19. A security system, comprising:

at least one antenna;

a transceiver to connect to said antenna and establish an interrogation zone using at least a first signal at a first frequency and a second signal at a second frequency; and a reader system to connect to said transceiver and configured to detect different security tags within said interrogation zone by receiving a third signal at a third frequency, said third signal comprising a combination of said first and second signals and filtering said third signal to remove frequency components of only said first signal.

20. The security system of claim 19, wherein one of said security tags is a Radio Frequency Identification (RFID) security tag, and one of said security tags is a Radio Frequency (RF) security tag.

21. The security system of claim 19, wherein said reader system comprises:

a filter to filter out said first signal from said third signal;

a detector to determine if said second signal is present in said filtered signal;

a decoder module to decode a unique identifier from a fourth signal received in response to said second signal; and an event module to generate an event signal in response to said detector or said decoder module.

22. The security system of claim 19, further comprising an alarm system to receive said event signal and to activate an alarm in response to said event signal.

23. The security system of claim 21, further comprising an inventory control system to receive said event signal and store information associated with said unique identifier.

24. The security system of claim 21, farther comprising a deactivation module to deactivate at least one of said security tags.

25. An article comprising:

a storage medium;

said storage medium including stored instructions that, when executed by a processor, result in detecting security tags by establishing an interrogation zone using at least two signals operating at different frequencies, monitoring said interrogation zone to detect a plurality of security tags, with a first type of security tag responsive to at least a first signal at a first frequency and a second type of security tag responsive to at least a second signal at a second frequency, determining whether to generate an alarm if a security tag is detected by receiving a third signal at a third frequency, said third signal comprising a combination of said first and second signals from a first security tag of said first type and filtering said third signal to remove frequency components of only said first signal, and generating said alarm in accordance with said determination.

26. The article of claim 25, wherein the stored instructions, when executed by a processor, further result in said establishing by transmitting said first signal at a said first frequency, and transmitting said second signal at said second frequency.

27. The article of claim 25, wherein the stored instructions, when executed by a processor, further result in said monitoring by receiving said third signal at a third frequency from said first security tag in response to said first and second signals.

28. The article of claim 25, wherein the stored instructions, when executed by a processor, further result in determining whether said second signal remains after said filtering, and sending an alarm signal if said second signal remains after said filtering.

29. The article of claim 28, wherein the stored instructions, when executed by a processor, further result in said generating by receiving said alarm signal, and triggering said alarm in response to said alarm signal.

30. The article of claim 25, wherein the stored instructions, when executed by a processor, further result in said monitoring by receiving a fourth signal from a second security tag of said second type in response to said second signal, said fourth signal representing security tag information stored by said second security tag.

31. The article of claim 30, wherein the stored instructions when executed by a processor, further result in said determining by decoding said security tag information from said fourth signal, said security tag information comprising an identifier for said second security tag, comparing said identifier to a list of valid identifier, determining whether said identifier is valid based on said comparison, and sending an alarm signal if said identifier is not valid.

32. The article of claim 31, wherein the stored instructions, when executed by a processor, further result in said generating by receiving said alarm signal, and triggering said alarm in response to said alarm signal.

* * * * *